United States Patent [19]

Belknap et al.

[11] Patent Number: 5,018,053

[45] Date of Patent: May 21, 1991

[54] ILLUMINATED JEWELRY

[75] Inventors: James D. Belknap, Imperial; Brian S. Ward, Ballwin, both of Mo.

[73] Assignee: Lazerware, Inc., St. Louis, Mo.

[21] Appl. No.: 599,441

[22] Filed: Oct. 18, 1990

[51] Int. Cl.[5] ..... F21L 15/08

[52] U.S. Cl. ..... 362/104; 362/800; 362/339; 362/253; 63/12; 63/13

[58] Field of Search ..... 362/104, 253, 334, 339, 362/800; 63/2, 12, 13, 1.1

[56] References Cited

U.S. PATENT DOCUMENTS

| | | | |
|---|---|---|---|
| 3,384,740 | 5/1968 | Wood | 63/14.1 |
| 3,968,357 | 7/1976 | Hamilton | 63/1.1 |
| 4,003,216 | 1/1977 | Cecere et al. | 63/12 |
| 4,785,642 | 11/1988 | Chin et al. | 63/1.1 |
| 4,802,070 | 1/1989 | Westmoland | 362/800 |
| 4,861,658 | 8/1989 | Griffin et al. | 63/1.1 |
| 4,942,744 | 7/1990 | Wei | 63/1.1 |

*Primary Examiner*—Ira S. lazarus
*Assistant Examiner*—Y. Quach
*Attorney, Agent, or Firm*—Rodger H. Flagg

[57] ABSTRACT

The present invention discloses illuminated jewelry which is adapted for use as an earring, lapel pin broach, tie clip, cuff link, etc. A light source, such as an LED, is molded with a non-conducting, light transmissive material, which is preferably faceted to provide multiple reflected images of the illuminated light source. A power source, such as a small battery, is held by a retainer which provides electrical contact with one terminal of the power source. A lead finding is pivotally secured to the retainer at one end, and is secured at the opposite end to the light source. A lead post is secured to the light source, and positioned to contact the opposite terminal of the power source to energize the light source when the retainer is moved to a closed position. When the retainer is moved to an open position, the circuit between the power supply and the light source is broken. A biasing means is disposed between the retainer and the lead finding, to urge the illuminated jewelry open and closed positions. In the open position, the illuminated jewelry may be easily secured to the wearer's clothing or through an opening in a pierced ear. The wearer then moves the illuminated jewelry to the closed position, which illuminates the jewelry while securing the jewelry to the wearer.

20 Claims, 2 Drawing Sheets

ILLUMINATED JEWELRY

BACKGROUND OF THE INVENTION

This invention relates to improvements in illuminated jewelry, for the purpose of adornment, and more particularly to earrings, lapel pins, broaches, tie clips, cuff links and other types of illuminated jewelry. A light source, such as an LED, is molded within a light transmittable material, which is preferably faceted to provide multiple reflected images of the light source when illuminated.

Illuminated jewelry has been known in the art for some time, which requires a variety of screws, clamps or other mechanisms for securing the illuminated jewelry to the user. Examples include U.S. Pat. Nos. 4,791,536 and 3,968,357.

Many of these prior art devices include separable parts which may become lost or misplaced, which will render the jewelry non-illuminating, if lost. Examples include U.S. Pat. Nos. 4,802,070 and 4,337,504.

Other prior art devices require an independent switch means to actuate the illuminated jewelry. Examples include U.S. Pat. Nos. 4,408,261; 4,719,544; 3,624,384 and 3,384,740.

U.S. Pat. No. 4,337,504 discloses an electronic earring having a conductive post for passing through an opening in the user's ear, wherein the battery must be removed from the jewelry to install or remove the device on the user's ear.

SUMMARY OF THE INVENTION

The present invention discloses self contained, illuminated jewelry comprising a battery engaging electrically conductive retainer pivotally secured at one end to a lead finding which is secured at the opposite end to a light source, such as a light emitting diode (LED) encapsulated within a non-conducting, light transmitting material. The light transmitting material is preferably faceted to provide multiple light images from the light source when the light source is energized. A lead post extends from the encapsulated material to releasably secure the illuminated jewelry to the user's pierced ear lobe or clothing. The lead post connects to the light source at one end and engages the power source at the opposite end to energize the light source when the illuminated jewelry is in the closed position.

A biasing means, such as a leaf spring, is disposed between the battery retainer and the lead finding extending from the light source. The leaf spring biases the illuminated jewelry between opened and closed positions.

The above mentioned and other features and objects of the invention, and the manner of attaining them will be best understood by reference to the following description of an embodiment of the invention, when considered in conjunction with the accompanying drawings:

BEST MODE FOR CARRYING OUT THE INVENTION

Figure 1:
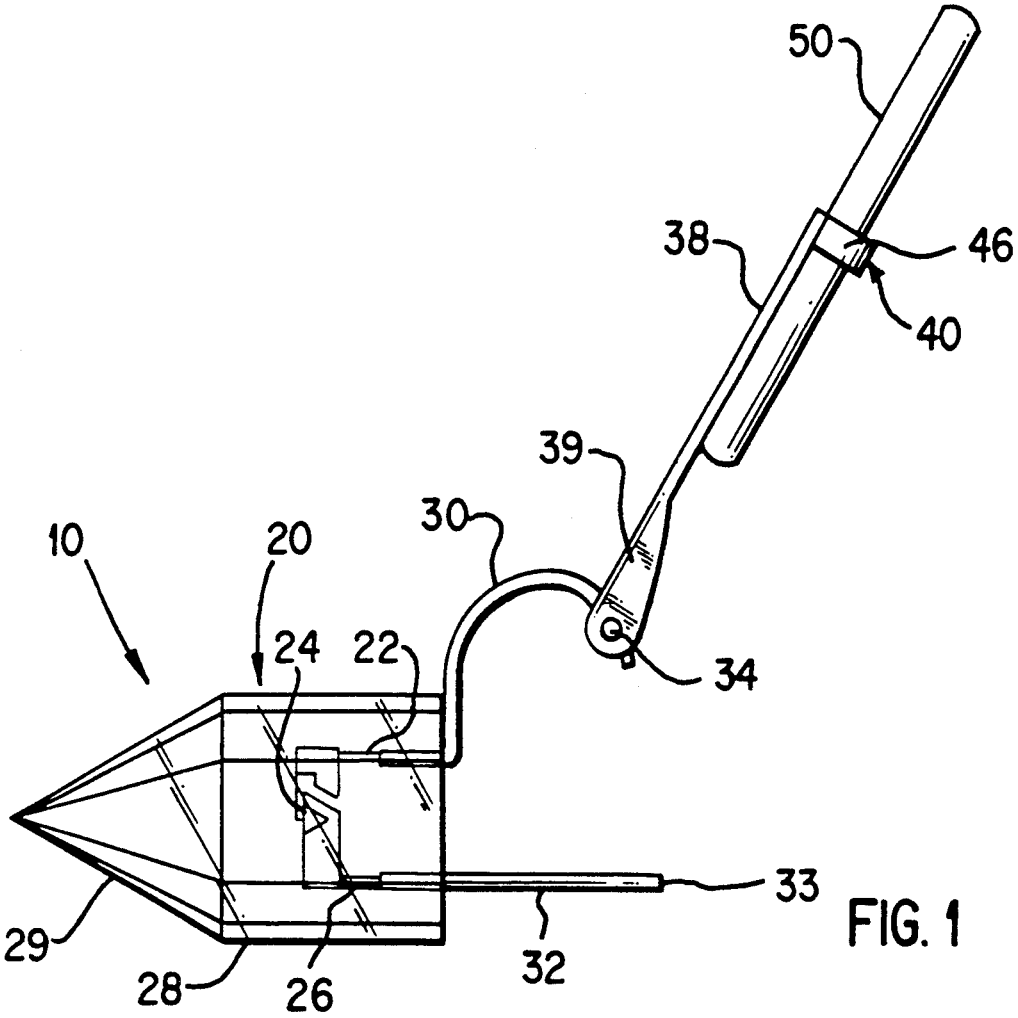
FIG. 1 is a side view of the illuminated jewelry, shown in open position.

The subject matter which I regard as my invention is particularly pointed out and distinctly claimed in the claims. The structure and operation of my invention, together with further objects and advantages, may be better understood from the following description given in connection with the accompanying drawings, in which:

FIG. 1 shows a side view of the illuminated jewelry 10, having a light transmissive, non-conducting material 20 which encapsulates a light source 24, such as a light emitting diode, (LED), having first and second electrically conducting leads 22, 26 extending from the light source 24.

The light source 24, may be selected from a variety of known light emitting elements, having various sizes, shapes, colors and voltages. Preferably the light source 24 provides a low voltage, high intensity colored light of small size suitable for encapsulation within the light transmissive material 20. The light source 24 should be long lasting and selected to not excessively drain the power supply 50. A light emitting diode (LED) is the preferred light source.

The light transmissive material 20 preferably has a body portion 28, with a multi-faceted surface portion 29, which acts to reflect light from the light source 24 in a pattern simulating multiple light sources. The multi-faceted surface portion 29 acts as a prism to reflect light and heighten the effect of the illuminated jewelry 10.

The light transmissive material 20 may be transparent or translucent, and may be colored with a pigment, dye or other known coloring means or surface preparation means to provide a colored light visually extending from the illuminated jewelry 10. The light transmissive material may be acrylic, glass or other known material suitable for encapsulating the light source 24, while providing a non-conductive, light transmissive material 20 as disclosed herein.

As shown in FIG. 1, the light transmissive material 20 may be cast in any desired shape or pattern. Additional light diffracting design elements (not shown) may be adapted for attachment to the encapsulated light source 24, for enlargment or enhancement of the illuminated jewelry 10, or to create a desired artistic effect. The addition or removal of additional design elements will change the outward appearance of the illuminated jewelry, without affecting the circuitry or the operation of the illuminated jewelry 10.

Referring now to FIG. 1, a conductive lead finding 30 is secured at one end to lead 22 extending from the light source 24. A conductive lead post 32 is secured at one end to lead 26 extending from the light source 24. The lead post 32 serves as a mounting for the illuminated jewelry 10 to the wearer's pierced ear lobe or to a selected location on the wearer's clothing.

Any means of securement, such as a solder connection, may be used to provide electrical communication between lead 22 and lead finding 30 or lead 26 and lead post 32. Where the means of securement may be toxic or may irritate the skin, such as when solder is used, it is preferred to encapsulate the means of securement within the light transmissive material 20, at the time the light source 24 is encapsulated. Encapsulation of lead 22 and a portion of lead finding 30; and lead 26 and a portion of lead post 32, serves to strengthen the connection between the component parts, while protecting the connection from the external environment.

Where the illuminated jewelry is warn close to the skin, such as when worn as illuminated earrings, encapsulation protects the user from contact with the solder connection, which may irritate sensitive skin.

End 33 of lead post 32 may be shortened without disfiguring the illuminated jewelry 10, to provide for adjustment to fit various thicknesses of material found in various apparel, or to suit various ear lobe thicknesses.

Referring now to FIG. 1, conductive lead finding 30 is formed into a rigid arch with one end 34 pivotally secured to the power supply retainer 40. Retainer 40, preferably comprises a strap 44 extending across the back portion of the power supply 50, with strap ends 46, 48 formed to engage the outer circumference of the power supply 50. A tee member 38 is secured to the strap 44, and extends from the strap 44 beyond the profile of the power supply 50. The Tee member 38 includes a formed end 36 with aligned apertures sized to rotatably secure end 34 of the lead finding 30. End 34 may be a pin secured to lead finding 30. Other known means of rotatable securement may also be used.

Figure 4:
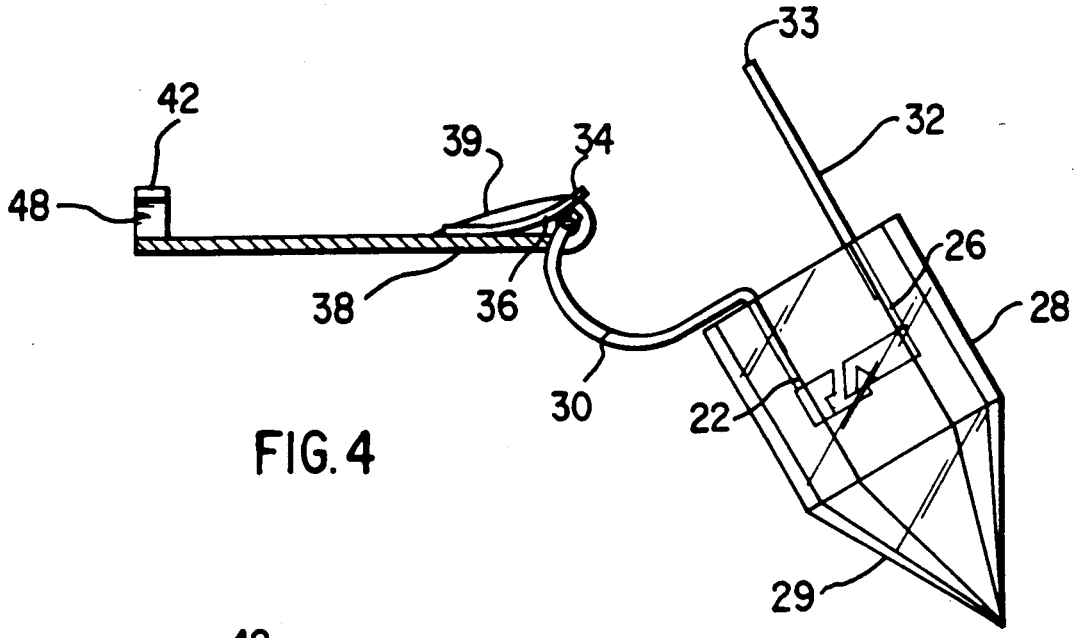
FIG. 4 is a sectional view of the retainer, showing the preferred leaf spring.
Figure 3:
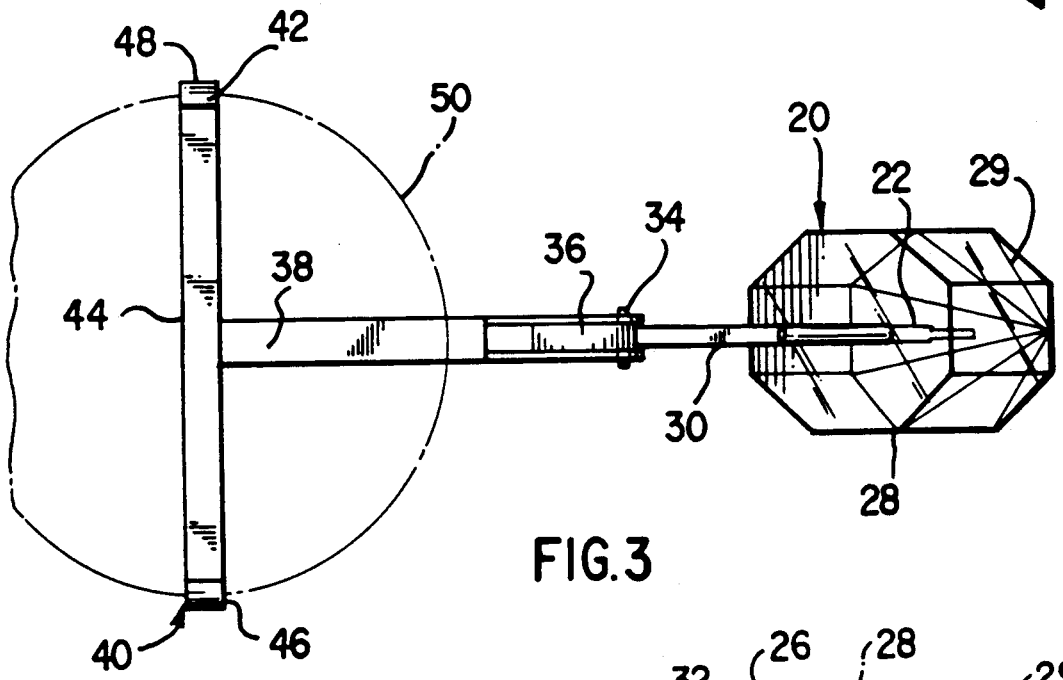
FIG. 3 is a top view of the illuminated jewelry, shown in the open position.
Figure 5:
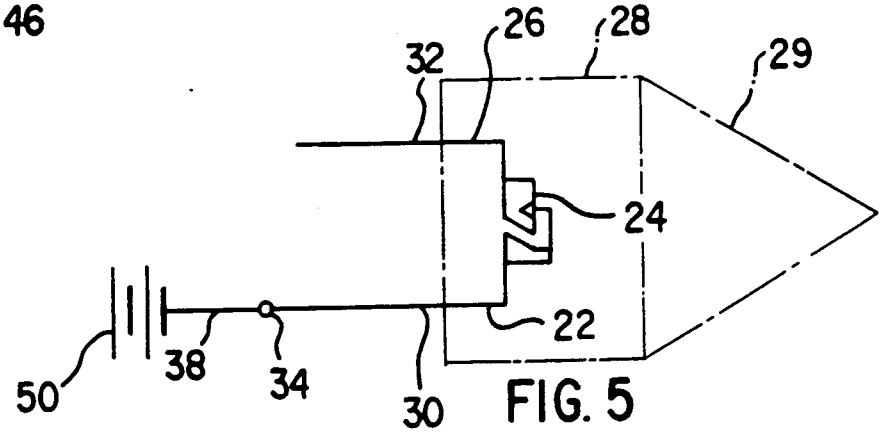
FIG. 5 is a schematic diagram showing the electrical circuitry of the invention.

Referring now to FIG. 4, a biasing member 39 is secured to tee member 38 by any conventional means, such as glueing, soldering, spot welding, etc. Biasing member 39 is preferably a leaf spring, secured to tee member 38 by crimping a portion of the tee member about the leaf spring. Alternately, the leaf spring may include tabs which are bent about the tee member 38. Biasing member 39 provides a resilient engagement with a raised portion disposed upon the pivotally secured end 34 of the first lead finding 30.

Figure 2:
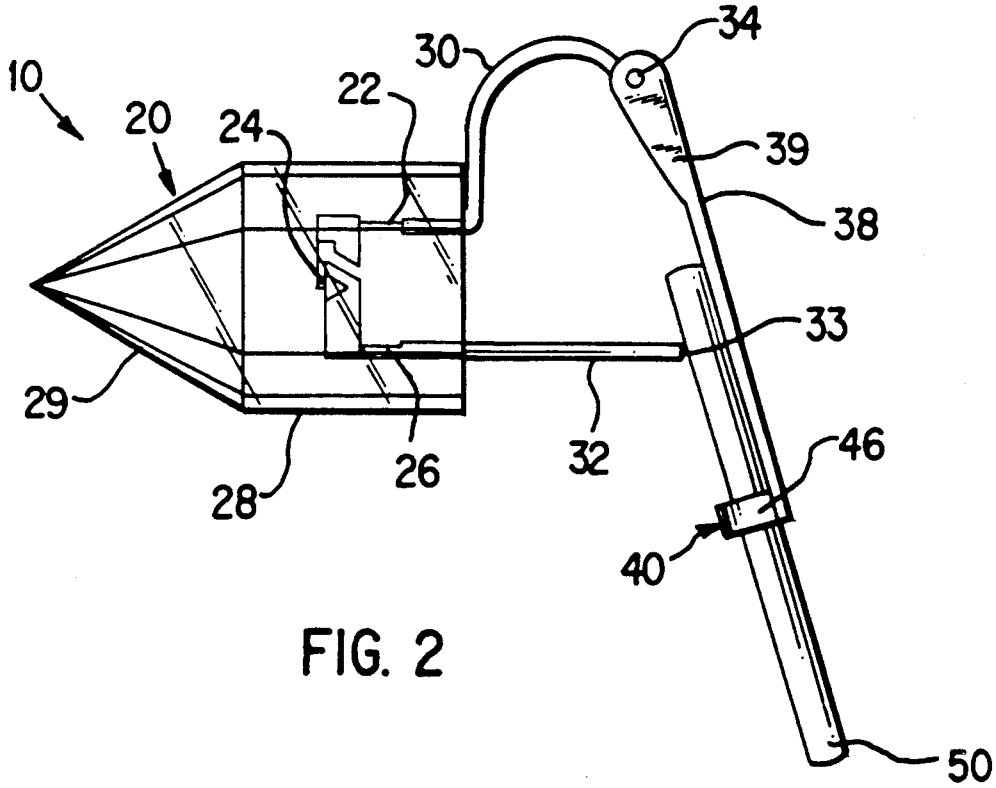
FIG. 2 is a side view of the illuminated jewelry, shown in closed position.

Retainer 40 may be moved from the open position shown in FIG. 1 to the closed position shown in FIG. 2. When tee member 38 is in the open position, the illuminated jewelry may be easily inserted or removed from the clothing or pierced ear lobe of the wearer. Conductive lead post 32 serves as a post for mounting the illuminated jewelry 10 through clothing, fabric or through a pierced ear. Biasing member 39 acts against the end of lead finding 30 to maintain the retainer 40 in open or closed positions.

To secure the illuminated jewelry 10 in place, the retainer 40 is pivoted about secured end 34 to the closed position shown in FIG. 2. In the closed position, biasing member 39 acts to maintain a closing pressure on the end of lead finding 30, ensuring contact between the tip 33 of lead post 32 and the power supply 50.

Power supply 50 may be any convenient power supply, such as used in watches, or other small electronic equipment. One such power supply is made by Eveready, model CR162O, having a 3 volt power rating. The power rating of the light source 24 should be compatible with the power rating of the power supply 50. Power supply 50 preferably is a circular disc having a positive terminal portion extending across the back and the outer circumference of the power supply 50. The front face of the power supply 50 is preferably a negative terminal portion. The preferred power supply is a lithium battery.

To change the power supply, the installed power supply 50 is pulled from retainer 40 against the resistance of ends 42, 46. A new power supply 50 is then installed by pushing the power supply 50 into resilient engagement with ends 42, 46 of retainer 40, with the back of the power supply positioned against strap 44 of retainer 40. Once installed, the power supply 50 need not be removed during installation or removal of the illuminated jewelry, until a replacement battery is required.

The wearer biases retainer 40 into the open position shown in FIG. 1, and inserts the conductive lead post 32 through the material of the wearer's clothing, or through the pierced portion of the wearer's ear. Once in place, the retainer 40 is pivotally rotated at 34 to a closed position shown in FIG. 2, wherein the tip 33 of lead post 32 abuts one terminal of the power supply 50, while the retainer 40 abuts the opposite terminal of the power supply 50. Preferably, the retainer abuts the positive terminal, and lead post 32 abuts the negative terminal of the power supply 50.

The light source 24 is energized by the power supply 50, which illuminates the light transmitting material 28. Where the surface of material 28 is faceted 29, multiple points of light are observed from a single light source 24, when viewed from the faceted end. The light source 24 disclosed herein is capable of being seen in daylight by the naked eye. The multifaceted light transmitting material 28 will project a light pattern onto a nearby wall or object when viewed in a dark environment.

Due to the low power requirements of the preferred light source 39, the illuminated jewelry 10 will produce the desired illumination for many hours before requiring a power source change.

The illuminated jewelry 10 disclosed herein is lightweight and portable; is easily installed or removed without requiring removal of any component parts; and may be worn as a stick pin for ties, or as a lapel pin, broach, earring, or other source of adornment without requiring modification of the circuitry or fastening means. The biasing member 39 maintains the jewelry 10 in opened or closed positions, while urging the retainer 40 and conductive lead finding 30 towards open or closed positions.

The biasing member 39 ensures contact between the conductive lead post 32 and the power source 50, when the illuminated jewelry 10 is in the closed position, with end 33 of lead post 32 abutting a terminal of the power supply 50.

Preferably, retainer 40, lead finding 30, lead post 32 and any other portion of the illuminated jewelry 10 which comes in contact with the user's skin is coated or plated with a hypo-allergenic material, to protect the wearer from allergic effects of various materials used in the fabrication of the illuminated jewelry. The tip 33 of lead post 32 may be cut off or otherwise foreshortened after coating or plating to ensure electrical contact with power supply 50.

The conductive lead post 32 may be coated with a non-conductive material to insulate the electrical current passing through the conductive lead post 32 from the battery. Where lead post 32 is coated as noted above, the tip 33 of lead post 32 should be free of non-conductive material, so that a suitable electrical contact is made between the power supply 50 and the tip 33 of lead post 32, when the lead post 32 is in the closed position shown in FIG. 2.

Thus, while the novel illuminated jewelry 10 has been fully disclosed and described herein, numerous modifications will become readily apparent to one of ordinary skill in this art, and such adaptions and modifications are intended to be included within the scope of the following claims.

What is claimed is:

1. An apparatus having a power source for illuminating jewelry, which comprises:

(a) A retainer sized to receive and retain the power source;

(b) an electrically conductive lead finding pivotally secured to the retainer;

(c) a light source having first and second electrically conductive leads, the first lead secured to the lead finding;

(d) an electrically conductive lead post secured to the second lead on the light source;

(e) a light transmissive, non-conducting material formed about the light source to encapsulate the light source and a portion of the lead finding and the lead post; and (f) a biasing member disposed between the retainer and the pivotally secured lead finding, the biasing member positioned to bias the retainer between a closed position wherein the lead post contacts the power source disposed within the retainer to energize the light source; and an open position which pivots the lead finding in relation to the retainer to break contact between the lead post and the power source, and for ease of insertion and removal of the illuminated jewelry.

2. The apparatus of claim 1, wherein the power source is a lithium battery.

3. The apparatus of claim 1, wherein the light source comprises at a light emitting diode.

4. The apparatus of claim 3, wherein the light emitting diode is selected to emit a colored light.

5. The apparatus of claim 1, wherein the retainer, the lead finding and the lead post are plated with a hypo-allergenic material.

6. The apparatus of claim 1, wherein the retainer comprises a strap extending across the back portion of the power supply, with strap ends formed to engage the outer circumference of the power supply, and a tee member extending from the strap to a formed end with aligned apertures sized to pivotally secure one end of the lead finding therein.

7. The apparatus of claim 6, wherein the biasing member is a leaf spring secured to the tee member, providing resilient engagement with a raised portion on the pivotally secured end of the lead finding.

8. The apparatus of claim 1, wherein the light transmissive, non-conductive material is cast with a multi-faceted surface formed to reflect light from the light source embedded within the light transmissive material in a pattern simulating multiple light sources.

9. The apparatus of claim 1, wherein the light transmissive, non-conductive material is cast from a colored material.

10. The apparatus of claim 1, wherein a light diffracting design element is disposed adjacent to the light transmissive, non-conductive material.

11. An apparatus for illuminated jewelry, which comprises:

(a) a power source having positive and negative terminals;

(b) a retainer sized to receive and retain the power source and to make electrical contact with the positive terminal of the power source;

(c) an electrically conductive lead finding pivotally secured at one end to the retainer;

(d) a light emitting diode having first and second electrically conductive leads extending therefrom; the first lead connected to the lead finding;

(e) a lead post secured to the second lead of the light emitting diode;

(f) a light transmissive, non-conducting material formed about the light emitting diode to encapsulate and secure the light emitting diode and a portion of the lead finding and the lead post therein;

(g) a biasing member disposed between the retainer and the pivotally secured lead finding, the biasing member positioned to bias the lead finding between a closed position where the lead post contacts the negative terminal of the power source to energize the light emitting diode, and an open position which pivots the lead finding in relation to the retainer to break contact between the lead post and the negative terminal of the power source.

12. The apparatus of claim 11, wherein the power source is a lithium battery.

13. The apparatus of claim 11, wherein the light emitting diode is selected to emit a colored light.

14. The apparatus of claim 11, wherein the electrically conductive lead finding and lead post are plated with a hypo-allergenic material.

15. The apparatus of claim 11, wherein the biasing member is a leaf spring secured to the retainer.

16. The apparatus of claim 11, wherein the light transmissive, non-conductive material is cast with a multi-faceted surface formed to reflect light from the light source in a pattern simulating multiple light sources.

17. An apparatus with a battery having positive and negative terminals for illuminating jewelry, which comprises:

(a) a retainer sized to receive and retain the battery and to make electrical contact with the positive battery terminal;

(b) an electrically conductive lead finding pivotally secured at one end to the retainer;

(c) an electrically conductive lead post;

(d) a light emitting diode with a first lead secured to the lead finding, and a second lead secured to the lead post;

(e) a light transmissive, non-conductive material formed around the light emitting diode to encapsulate and seal the light emitting diode and a portion of the lead finding and the lead post therein;

(f) a biasing member disposed between the retainer and the pivotally secured lead finding, the biasing member positioned to bias the lead finding between a closed position wherein the lead post contacts the negative battery terminal to energize the light emitting diode, and an open position wherein contact between the lead post and the negative battery terminal is broken.

18. The apparatus of claim 17, wherein the light emitting diode is selected to emit a colored light.

19. The apparatus of claim 17, wherein the retainer and the electrically conductive lead finding and the lead post are plated with a hypo-allergenic material.

20. The apparatus of claim 17, wherein the light transmissive, non-conductive material is cast with a multi-faceted surface formed to reflect light from the light emitting diode in a pattern simulating multiple light sources.

* * * * *